US008205670B2

(12) United States Patent
Nelson

(10) Patent No.: US 8,205,670 B2
(45) Date of Patent: Jun. 26, 2012

(54) METAL ANNULUS SEAL

(75) Inventor: John E. Nelson, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 160 days.

(21) Appl. No.: 12/838,024

(22) Filed: Jul. 16, 2010

(65) Prior Publication Data

US 2010/0276162 A1 Nov. 4, 2010

Related U.S. Application Data

(62) Division of application No. 12/268,858, filed on Nov. 11, 2008, now Pat. No. 7,762,319.

(51) Int. Cl.
*E21B 19/00* (2006.01)

(52) U.S. Cl. ..... 166/84.1; 166/387; 166/368; 277/329

(58) Field of Classification Search ..... 166/387, 166/88.1, 84.1, 368, 75.11, 85.3; 277/329
See application file for complete search history.

(56) References Cited

U.S. PATENT DOCUMENTS 4,615,544 A * 10/1986 Baugh ..... 285/18
4,665,979 A 5/1987 Boehm, Jr.
4,714,111 A 12/1987 Brammer
4,742,874 A * 5/1988 Gullion ..... 166/348
4,751,965 A * 6/1988 Cassity ..... 166/182
4,932,472 A * 6/1990 Boehm, Jr. ..... 166/208
4,949,786 A * 8/1990 Eckert et al. ..... 166/208
4,949,787 A * 8/1990 Brammer et al. ..... 166/208
5,044,672 A * 9/1991 Skeels et al. ..... 285/98
5,060,724 A * 10/1991 Brammer et al. ..... 166/208
5,110,144 A * 5/1992 Burton et al. ..... 277/328
5,174,376 A * 12/1992 Singeetham ..... 166/208
5,255,746 A * 10/1993 Bridges ..... 166/348
5,285,853 A 2/1994 Eckert et al.
5,307,879 A * 5/1994 Kent ..... 166/382
5,325,925 A * 7/1994 Smith et al. ..... 166/387
5,456,314 A * 10/1995 Boehm et al. ..... 166/208
5,638,903 A * 6/1997 Kent ..... 166/348
6,176,310 B1 * 1/2001 Smith et al. ..... 166/89.1
6,367,558 B1 4/2002 Borak, Jr.
2010/0126736 A1 * 5/2010 Ellis et al. ..... 166/387

* cited by examiner

*Primary Examiner* — William P Neuder
*Assistant Examiner* — Elizabeth Gottlieb
(74) *Attorney, Agent, or Firm* — Bracewell & Giuliani LLP

(57) ABSTRACT

A wellhead seal assembly forms a metal-to-metal seal between inner and outer wellhead members. A metal seal ring has inner and outer walls separated by a slot. An energizing ring has a C-ring captured on its outer surface. When the energizing ring is moved further into the slot, the C-ring is forced from its pocket and engages a profile on the seal ring, locking the energizing ring to the seal assembly.

7 Claims, 4 Drawing Sheets

METAL ANNULUS SEAL

CROSS-REFERENCE TO RELATED APPLICATION

This application is a divisional application of U.S. patent application Ser. No. 12/268,858, filed Nov. 11, 2008.

FIELD OF THE INVENTION

This invention relates in general to wellhead assemblies and in particular to a seal for sealing between inner and outer wellhead members.

BACKGROUND OF THE INVENTION

Seals are used between inner and outer wellhead tubular members to contain internal well pressure. The inner wellhead member may be a tubing hanger that supports a string of tubing extending into the well for the flow of production fluid. The tubing hanger lands in an outer wellhead member, which may be wellhead housing, a Christmas tree, or tubing head. A packoff or seal seals between the tubing hanger and the outer wellhead member. Alternately, the inner wellhead member might be a casing hanger located in a wellhead housing and secured to a string of casing extending into the well. A seal or packoff seals between the casing hanger and the wellhead housing.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

A need exists for a technique that addresses the seal leakage problems described above. The following technique may solve one or more of these problems.

SUMMARY OF THE INVENTION

In an embodiment of the present technique, a seal assembly is provided that forms a metal-to-metal seal and has features that restrain axial movement of an energizing ring of the seal assembly. The seal assembly also has features that enable retrieval without risk of seal disassembly. The seal ring has inner and outer walls separated by a slot. The metal energizing ring is pushed into the slot during installation to deform the inner and outer walls into sealing engagement with inner and outer wellhead members.

In the embodiment shown, the seal assembly comprises an energizing ring that engages the slot. A C-ring rests in a machined pocket on the outer surface of the energizing ring. The outer leg of the seal ring is machined with a taper that engages a taper formed on the C-ring. The engagement ensures that the seal assembly remains intact as one solid structure during landing, setting, and retrieval operations.

In an alternate embodiment of the present invention, a C-ring rests in a machined pocket on the inner surface of the energizing ring. The C-ring engages the hanger when the seal is set, locking the seal to the hanger.

In the illustrated embodiments, a radial gap exists between the outer wall of the seal and the inner wall of the mating housing. Such gap is required for installation in the field and is sufficiently large to require plastic deformation of the seal body, but not the energizer ring. In order to accommodate sealing over scratches and surface trauma of the wellhead members, soft metallic inserts may be provided for on the seal. The size and thickness of the metallic inserts are sufficient to provide for scratch filling and therefore sealing between the mating members.

The combination of stored energy provided for by the energizing rings, the locking mechanisms of the seal ring and the energizing ring, and the compliant soft outer inserts, provides gas tight sealing under extreme thermal conditions. Alternatively, the soft inserts may be made from a non-metallic material or polymer such as PEEK (poly-ether-ether-keytone) or PPS (polyphenylene sulfide).

DETAILED DESCRIPTION OF THE INVENTION

Figure 1:
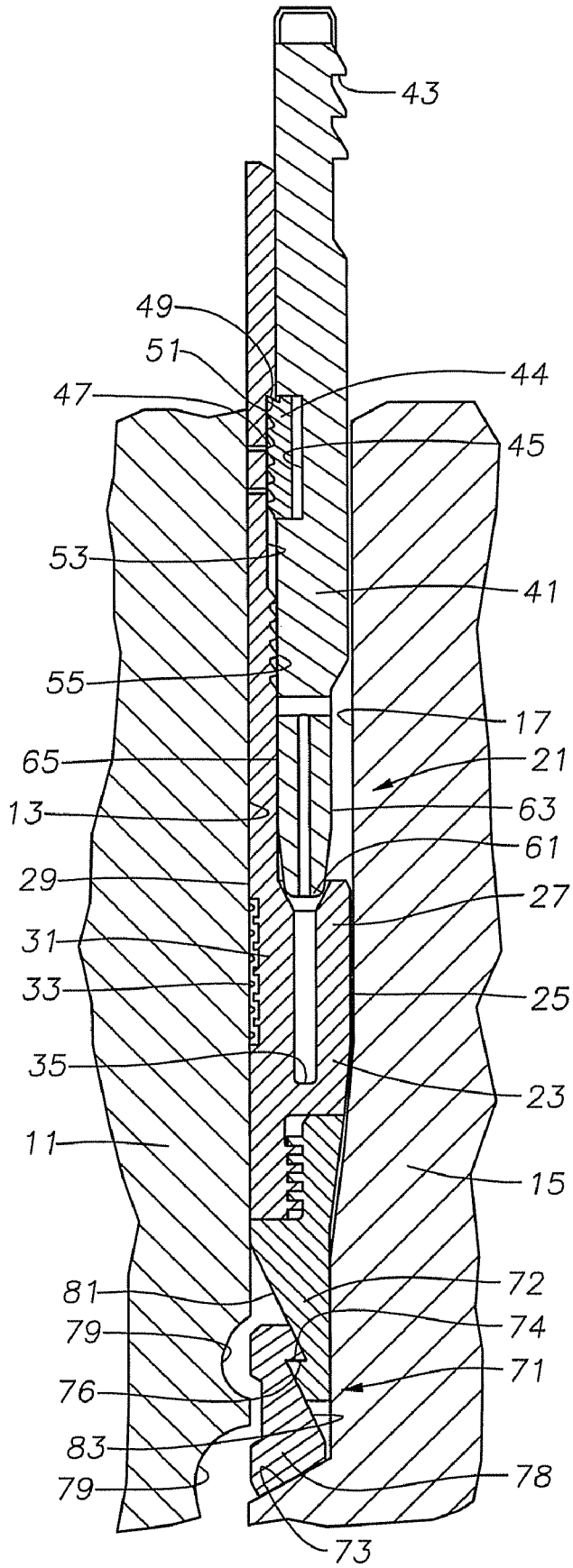
FIG. 1 is a sectional view of a seal assembly constructed in accordance with the present technique with the energizing ring locked to the seal, but unset.

Referring to FIG. 1, a portion of a high pressure wellhead housing 11 is shown. Housing 11 is located at an upper end of a well and serves as an outer wellhead member in this example. Housing 11 has a bore 13 located therein.

In this example, the inner wellhead member comprises a casing hanger 15, which is shown partially in FIG. 1 within bore 13. Alternately, wellhead housing 11 could be a tubing spool or a Christmas tree. Alternately, casing hanger 15 could be a tubing hanger, plug, safety valve or other device. Casing hanger 15 has an exterior annular recess radially spaced inward from bore 13 to define a seal pocket 17.

A metal-to-metal seal assembly 21 is located in seal pocket 17. Seal assembly 21 includes a seal ring 23 formed of a metal such as steel. Seal ring 23 has an inner wall 25 comprised of inner seal leg 27 for sealing against the cylindrical wall of seal pocket 17. Seal ring 23 has an outer wall surface 29 comprised of outer seal leg 31 that seals against wellhead housing bore 13. In this example outer wall 29 contains inlays 33 formed of a soft metal or alternatively made from a non-metallic material or polymer such as PEEK (poly-ether-ether-keytone) or PPS (polyphenylene sulfide). Each wall surface 25, 29 is cylindrical and smooth.

In this example, seal ring 23 is uni-directional, having an upper section only; however, a seal ring that is bi-directional may be used. The upper section has a slot 35. The inner and outer surfaces forming slot 35 comprise generally cylindrical surfaces that may be straight.

An energizing ring 41 engages slot 35 on the upper side. Energizing ring 41 is forced downward into slot 35 by a running tool (not shown) connected to grooves 43 on upper energizing ring 41 during setting. Alternatively, seal assembly 21 and energizing ring 41 may be part of a string that is lowered into bore 13, the weight of which forces energizing ring 41 into slot 35. Energizing ring 41 is formed of metal, such as steel. The mating surfaces of energizing ring 41 and outer seal leg 31 may be formed at a locking taper.

An outwardly biased C-ring 44 is carried in a pocket 45 on the outer surface of upper energizing ring 41. Ring 44 has parallel grooves 47 on its outer surface and an edge that forms an upward facing shoulder 49. The inner surface of outer seal leg 31 contains a downward facing shoulder 51 that abuts against shoulder 49 of C-ring 44, preventing energizing ring 41 from pulling out of seal ring 23 once the two are engaged.

A recess 53 is formed below shoulder 51 on the inner surface of outer seal leg 31. Parallel grooves 55 are formed on the inner surface of outer seal leg 31 just below recess 53. When energizing ring 41 is set, C-ring 44 will move radially from pocket 45, and grooves 47 on the outer surface of C-ring 44 will engage and ratchet by grooves 55 on the inner surface of outer seal leg 31, locking energizing ring 41 to seal ring 23. C-ring 44 can move downward relative to grooves 55, but not upward.

Energizing ring 41 has a wedge member 61 or engaging portion that engages slot 35. Energizing ring 41 has an inner surface 63 and an outer surface 65 for engaging the opposite inner sidewalls of slot 35. Inner and outer surfaces 63, 65 may be straight surfaces as shown, or curved surfaces.

Figure 2:
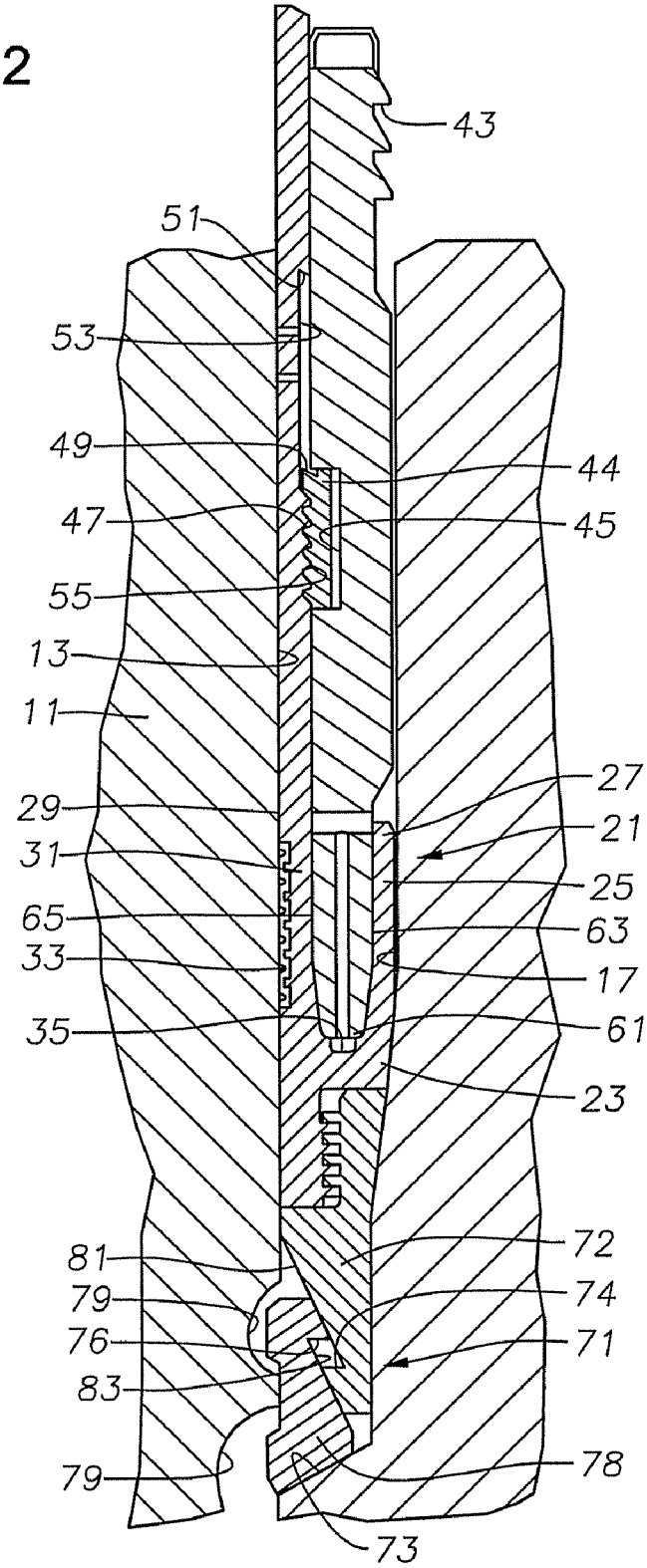
FIG. 2 is a sectional view of the seal assembly of FIG. 1 in the set position.

A retaining assembly 71 is attached to the bottom of seal ring 23 and acts to restrain axial movement of the seal assembly 21 relative to the outer wellhead member 11 when the assembly 21 is set. In this example, a nose ring 72 has a hook 74 that engages a hook 76 of axial restraining member 78. When axial restraining member 78 lands on casing hanger shoulder 73, nose ring 72 moves downward relative to axial restraining member 78 and hooks 74, 76 separate as shown in FIG. 2. Nose ring 72 and axial restraining member 78 also have mating tapered surfaces 81, 83 that produce a mechanical advantage to drive the axial restraining member 78 outward into an inner profile 79 of the bore 13 of wellhead housing 11. Axial movement of the seal assembly 21 relative to the wellhead 11 causes engagement between the axial restraining member 78 and the inner profile 79 of the wellhead housing 11. In the illustrated embodiment, the axial restraining member 78 and the housing 11 are not preloaded. However, the axial restraining member 78 and the housing 11 may be adapted to produce a preloading force when engaged.

In operation, a running tool or string is attached to seal assembly 21 (FIG. 1) and lowered into the well. For example, a running tool (not shown) can be attached to threads 43 on energizing ring 41. Seal assembly 21 is pre-assembled with energizing ring 41, C-ring 44, seal ring 23, and retaining assembly 71 all connected to one another. As seal assembly 21 is lowered into bore 13, locking assembly 71 lands on hanger shoulder 73. The weight of the running tool or the string causes nose ring 72 to move further downward relative to axial restraining member 78. The relative movement also causes axial restraining member 78 to expand radially, initially driving seal assembly 21 to the outer wellhead member 11, as shown in FIG. 2.

The continued downward movement of the running tool (not shown) and energizing ring 41 relative to shoulder 73 further reduces the axial distance between locking assembly 71 and energizing ring 41. The reduction causes energizing ring 41 to advance further into slot 35. This axial movement of energizing ring 41 forces inner wall 25 radially inward into sealing engagement with the cylindrical wall of seal pocket 17. This axial movement also forces outer wall 29 of seal ring 23 outward into sealing engagement with the wall of bore 13. As energizing ring 41 moves axially, C-ring 44 rides against recess 53. Energizing ring 41 continues advancing into slot 35, and C-ring 44 and grooves 47 engage and ratchet by grooves 55 on the inner surface of seal leg 31. As a result, C-ring 44 locks energizing ring 41 to seal ring 23 as shown in FIG. 2. Vent passages or penetration holes may be incorporated across wedge 61 and through upper energizing ring 41 so that a hydraulic lock condition does not prevent axial make-up of the energizer and seal system.

Because of the initial locking interface between retaining assembly 71 and wellhead member 11, and the locking interface between C-ring 44 and seal ring 23, an increase in axial length of seal pocket 17 due to thermal growth will not cause energizing ring 41 to back out of slot 35. Thus, reducing the possibility of leakage from the seal assembly 21. The deflection of inner and outer walls 25, 29 of seal ring 23 is not beyond the elastic limit or yield strength of the metal of seal ring 23, and thus is not permanent. The locking of energizer ring 41 to seal 31 prevents it from moving upward in the event of thermal growth, particularly if the thermal grow cycles. If thermal growth causes hanger 15 to move upward relative to housing 11, nose ring 72 would be able to move upward relative to axial restraining member 78. Thus, inner wall 25 will not be forced to slide on seal pocket 17. Rather, that portion of seal 21 would move axially upward with casing hanger 15. The outer seal leg 31 might slide slightly relative to housing 11 in such event, but inlays 33 are capable of accommodating such movement.

In the event that seal assembly 21 is to be removed from bore 13, a running tool is connected to threads 43 on upper energizing ring 41. An upward axial force is applied to upper energizing ring 41, causing it to withdraw from slot 35 and C-ring 44 to disengage grooves 55 on seal leg 31. However, due to retaining shoulders 49, 51, energizing ring 41 will remain engaged with seal ring 23, preventing the two from fully separating (FIG. 1).

Figure 3:
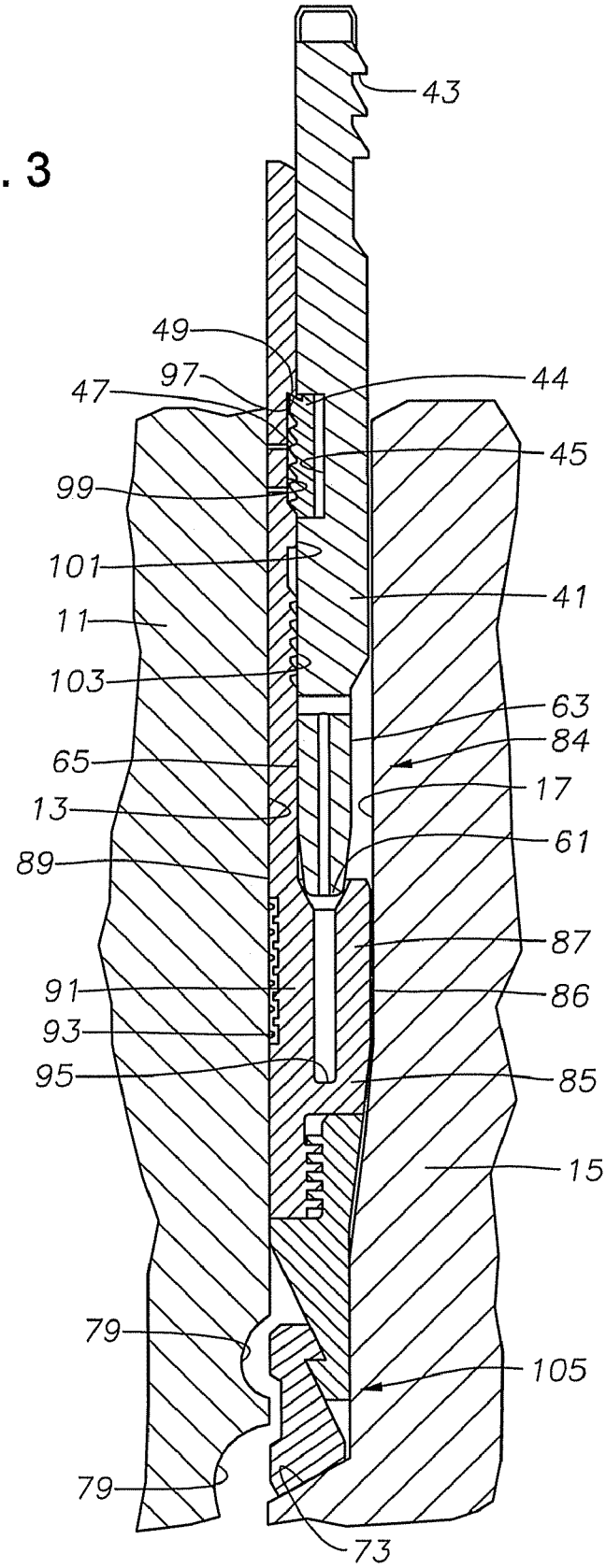
FIG. 3 is a sectional view similar to FIG. 1, but showing an alternate embodiment of the seal assembly.

Referring to FIG. 3, in an alternate embodiment of the present invention, a seal assembly 84 is constructed with a modified seal ring 85. Seal ring 85 is formed of a metal such as steel. Seal ring 85 has an inner wall 86 comprised of inner seal leg 87 for sealing against the cylindrical wall of seal pocket 17. Seal ring 85 has an outer wall surface 89 comprised of outer seal leg 91 that seals against wellhead housing bore 13. In this example outer wall 89 contains inlays 93 formed of a soft metal or alternatively made from a non-metallic material or polymer such as PEEK (poly-ether-ether-keytone) or PPS (polyphenylene sulfide). Each wall surface 86, 89 is cylindrical.

In this example, seal ring 85 is uni-directional, having an upper section only; however, a seal ring that is bi-directional may also be used. The upper section has a slot 95. The inner and outer surfaces forming slot 95 comprise generally cylindrical surfaces that may be straight.

An energizing ring 41 engages slot 95 on the upper side. Upper energizing ring 41 is forced downward into slot 95 by a running tool (not shown) connected to grooves 43 on energizing ring 41 during setting. Alternatively, seal assembly 84 and energizing ring 41 may be part of a string that is lowered into bore 13, the weight of which forces energizing ring 41 into slot 95. Energizing rings 41 is formed of metal, such as steel.

The mating surfaces of energizing ring 41 and outer seal leg 91 may be formed at a locking taper. An outwardly biased C-ring 44 is carried in a pocket 45 on the outer surface of upper energizing ring 41. Ring 44 has grooves 47 on its outer surface and an upper edge that forms an upward facing shoulder 49. The inner surface of outer seal leg 91 contains a downward facing shoulder 97 that abuts against shoulder 49 of C-ring 44, preventing energizing ring 41 from pulling out of seal ring 85 once the two are engaged.

A recess 99 is formed below shoulder 97 on the inner surface of outer seal leg 91. Just below recess 99, the inner surface of outer seal leg 91 extends radially inward from recess 99 and returns to its original thickness forming a smaller diameter portion 101. Just below section 101 of the outer seal leg 91, grooves 103 are formed on the inner surface of outer seal leg 91. When seal assembly 84 lands, recess 99 prevents energizing ring 41 from prematurely setting in seal ring 85. When seal assembly 84 is being set, C-ring 44 will move radially from pocket 45, and grooves 47 on the outer surface of C-ring 44 will engage and ratchet by grooves 103 on the inner surface of outer seal leg 91, locking energizing ring 41 to seal ring 85.

Energizing ring 41 has a wedge member 61 or engaging portion that engages slot 95. Energizing ring 41 has an inner surface 63 and an outer surface 65 for engaging the opposite inner sidewalls of slot 95. Inner and outer surfaces 63, 65 may be straight surfaces, as shown, or curved surfaces.

A locking assembly 105 is attached to the bottom of seal ring 85 and acts to lock the seal assembly 81 to the outer wellhead member 11 when the assembly 84 is set. The second embodiment operates in the same manner as the first.

Figure 4:
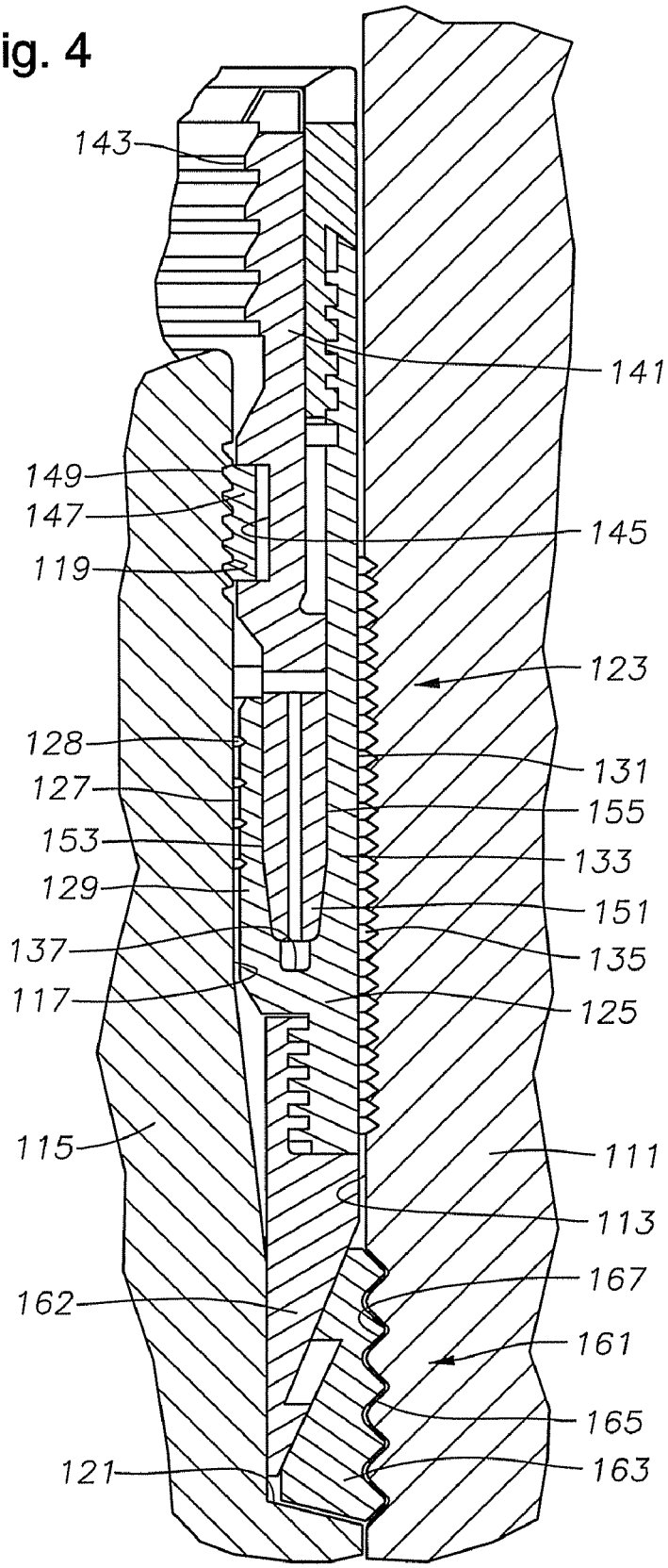
FIG. 4 is a sectional view similar to FIG. 1, but showing a second alternate embodiment of the seal assembly.

Referring to FIG. 4, another alternate embodiment of the present invention is illustrated. A portion of a high pressure wellhead housing 111 is shown. Housing 111 is located at an upper end of a well and serves as an outer wellhead member in this example. Housing 111 has a bore 113 located therein.

In this example, the inner wellhead member comprises a casing hanger 115, which is shown partially in FIG. 4 within bore 113. Alternately, wellhead housing 111 could be a tubing spool or a Christmas tree. Alternately, casing hanger 115 could be a tubing hanger, plug, safety valve or other device. Casing hanger 115 has an exterior annular recess radially spaced inward from bore 113 to define a seal pocket 117. In this embodiment, grooves 119 are positioned along a length of the outer surface of casing hanger 115, above seal pocket 117. Grooves 119 comprise parallel annular grooves extending around casing hanger 115. Casing hanger 15 has an upward facing shoulder 121 that defines the lower end of seal pocket 117.

A seal assembly 123 is constructed with a seal ring 125 formed of a metal such as steel. Seal ring 125 has an inner wall 127 comprised of inner seal leg 129 for sealing against the cylindrical wall of seal pocket 117. In this example inner wall 127 contains inlays 128 formed of a soft metal or alternatively made from a non-metallic material or polymer such as PEEK (poly-ether-ether-keytone) or PPS (polyphenylene sulfide). Seal ring 125 has an outer wall surface 131 comprised of outer seal leg 133 that seals against wellhead housing bore 113. In this example inner wall 131 contains parallel grooves 135 formed in bore 113 of wellhead member 111.

In this example, seal ring 125 is uni-directional, having an upper section only; however, a seal ring that is bi-directional is feasible. The upper section has a slot 137. The inner and outer surfaces forming slot 137 comprise generally cylindrical surfaces that may be straight.

An energizing ring 141 engages slot 137 on the upper side. Energizing ring 141 is forced downward into upper slot 137 by a running tool (not shown) connected to grooves 143 on upper energizing ring 141 during setting. Alternatively, seal assembly 123 and energizing ring 141 may be part of a string that is lowered into bore 113, the weight of which forces energizing ring 141 into slot 137. Energizing ring 141 is formed of metal, such as steel.

The inner surface of upper energizing ring 141 forms a pocket 145. An inwardly biased C-ring 147 with grooves 149 on its inner surface rides in pocket 145. When seal assembly 123 is being set, C-ring 147 moves radially inward from pocket 145 on upper energizing ring 141 and grooves 149 mate with grooves 119 on casing hanger 115, locking the seal assembly 123 to casing hanger 115.

Energizing ring 141 has a wedge member 151 or engaging portion that engages slot 137. Energizing ring 141 has an inner surface 153 and an outer surface 155 for engaging the opposite inner sidewalls of slot 137. Inner and outer surfaces 153, 155 may be straight surfaces, as shown, or curved surfaces.

A locking assembly 161 is attached to the bottom of seal ring 125 and acts to lock the seal assembly 123 to the outer wellhead member 111 when the assembly 123 is set. In this example, a nose ring 162 is connected to seal ring 125. In this embodiment, the seal assembly 123 has an axial restraining member 163 that has a toothed profile 165 that is adapted to engage a corresponding toothed profile 167 in the wellhead housing 111. However, in this embodiment, the engagement between the toothed profile 165 of the axial restraining member 163 and the toothed profile 167 of the housing 111 preloads the engagement between the axial restraining member 163 and the housing 111.

In operation, a running tool or string is attached to seal assembly 123 (FIG. 4) and lowered into the well. For example, a running tool (not shown) can be attached to threads 143 on energizing ring 141. Seal assembly 123 is pre-assembled with energizing ring 141, C-ring 147, seal ring 125, and locking assembly 161 all connected to one another. As seal assembly 123 is lowered into bore 113, locking assembly 161 lands on hanger shoulder 121. The weight of the running tool or the string causes the locking assembly 161 to move radially, locking seal assembly 123 to the outer wellhead member 111.

The continued downward movement of running tool (not shown) and energizing ring 141 relative to shoulder 121 further reduces the axial distance between locking assembly 161 and energizing ring 141. The reduction causes energizing ring 141 to advance further into slot 137. This axial movement of energizing ring 141 forces inner wall 127 radially inward into sealing engagement with the cylindrical wall of seal pocket 117. This axial movement also forces outer wall 131 of seal ring 125 outward into sealing engagement with the wall of bore 113. As upper energizing ring 141 moves axially, C-ring 147 rides in pocket 145. As energizing ring 141 continues advancing into slot 137, C-ring 147 moves radially inward and grooves 149 engage and ratchet by grooves 119 on the outer surface of casing hanger 115. As a result, C-ring 117 locks energizing ring 141 to casing hanger 115. Vent passages or penetration holes may be incorporated across wedge 151 and through upper energizing ring 141 so that a hydraulic lock condition does not prevent axial make-up of the energizer and seal system.

Because of the locking interface between locking assembly 161 and wellhead member 111, and the locking interface between C-ring 147 and casing hanger 115, an increase in axial length of seal pocket 117 due to thermal growth will not cause energizing ring 141 to back out of slot 137. The deflection of the inner and outer walls 127, 131 of seal ring 125 is not beyond the elastic limit or yield strength of the metal of seal ring 125, and thus is not permanent.

The locking C-ring allows the entire seal assembly to be set, landed, and removed as one solid structure, reducing the risk of having to recover a single seal assembly component in the bore. Additionally, the alternate embodiment allows the seal assembly to be locked to the inner wellhead member, limiting axial movement of the seal assembly itself relative to the inner wellhead member.

While the invention has been shown in only one of its forms, it should be apparent to those skilled in the art that it is not so limited but is susceptible to various changes without departing from the scope of the invention. For example, the seal could be configured for withstanding pressure in two directions, if desired, having two energizing rings. In addition, each energizing ring could be flexible, rather than solid.

The invention claimed is:

1. A wellhead seal assembly for sealing between inner and outer wellhead members, comprising:

a metal seal ring having inner and outer walls separated by a generally cylindrical slot;

a metal energizing ring generally cylindrical in shape with surfaces that slidingly engage the inner surfaces of the slot of the seal ring during installation to push the inner and outer walls of the seal ring into sealing engagement with the inner and outer wellhead members;

a resilient latch member mounted in an annular recess on an outer diameter of the energizing ring, the latch member being moved into latching engagement with the seal ring in response to movement of the energizing ring relative to the seal ring to prevent movement of the energizing ring out of the slot; and a tapered surface on the metal seal ring initially abuttingly contacting the resilient latch member to prevent movement of the resilient latch member relative to the seal ring at a select applied force to prevent premature movement of the energizing ring into the slot of the seal ring, whereby increased force on the energizing ring causes the latch member to move radially into the annular recess, thus allowing movement of the resilient latch member and energizing ring relative to the seal ring.

2. The seal assembly according to claim 1, wherein the latch member comprises a radially expandable and contractible metal ring.

3. The seal assembly according to claim 1, wherein the latch member comprises a radially expandable and contractible metal ring having a set of teeth formed thereon.

4. The seal assembly according to claim 1, further comprising:

a profile fowled on an inner surface of one of the walls of the seal ring below the tapered surface; and wherein the latch member engages the profile while in latching engagement.

5. The seal assembly according to claim 1, further comprising:

an axial restraining member having a tapered inner surface and an outer surface with grooves for engaging the inner surface of the outer wellhead member during installation for locking the seal assembly to the outer wellhead member.

6. The seal assembly according to claim 1, wherein the seal ring has a set of grooves formed on an inner surface of the outer wall; and the latch member has a set of teeth that ratchet into engagement with the grooves as the energizing ring moves into the slot.

7. The seal assembly according to claim 1, wherein during run-in, the latch member is trapped between mating recesses on the energizing ring and the seal ring, preventing the energizing ring from moving away from the slot.

* * * * *